United States Patent [19]

Weniger et al.

[11] 4,363,017

[45] Dec. 7, 1982

[54] RESISTOR DEVICE PARTICULARLY FOR HIGH-VOLTAGE INSTALLATIONS

[75] Inventors: Manfred Weniger; Manfred Just, both of Berlin, Fed. Rep. of Germany

[73] Assignee: Siemens Aktiengesellschaft, Munich, Fed. Rep. of Germany

[21] Appl. No.: 266,305

[22] Filed: May 22, 1981

[30] Foreign Application Priority Data

May 30, 1980 [DE] Fed. Rep. of Germany ... 8014833[U]

[51] Int. Cl.[3] ..... H01C 7/10

[52] U.S. Cl. ..... 338/21; 361/127

[58] Field of Search ..... 338/21; 361/126–128, 361/117, 131

[56] References Cited

U.S. PATENT DOCUMENTS 1,873,499 8/1932 Steinmayer ..... 338/21 X 2,890,383 6/1959 Olsen ..... 361/128 X

FOREIGN PATENT DOCUMENTS 163127 5/1949 Austria ..... 338/21

*Primary Examiner*—C. L. Albritton

*Attorney, Agent, or Firm*—Kenyon & Kenyon

[57] ABSTRACT

Disclosed is a stacked resistor device particularly for high-voltage installations. The resistor device includes inner and outer annular resistance elements of different diameters which are adjacently disposed along a common axis to form a stack. The resistance elements are electrically connected by annular-shaped contact elements. The contact elements include an annular recess of larger diameter on one side for receiving the outer resistance element and an annular recess of smaller diameter on the other side for receiving the inner resistance element, and include a central cutout through which a clamping sleeve of plastic material is inserted. Bushings and clamping parts are disposed at opposed ends of the sleeve to clamp the resistance elements and contact elements together to form the stacked resistor device. The contact elements not only provide for electrical connections between resistance elements but also provide a bearing surface for the resistance elements so that in cooperation with the bushings inserted into opposite ends of the clamping sleeve, the resistance elements and contact elements are clamped together into a compact and mechanically strong resistor device.

10 Claims, 1 Drawing Figure

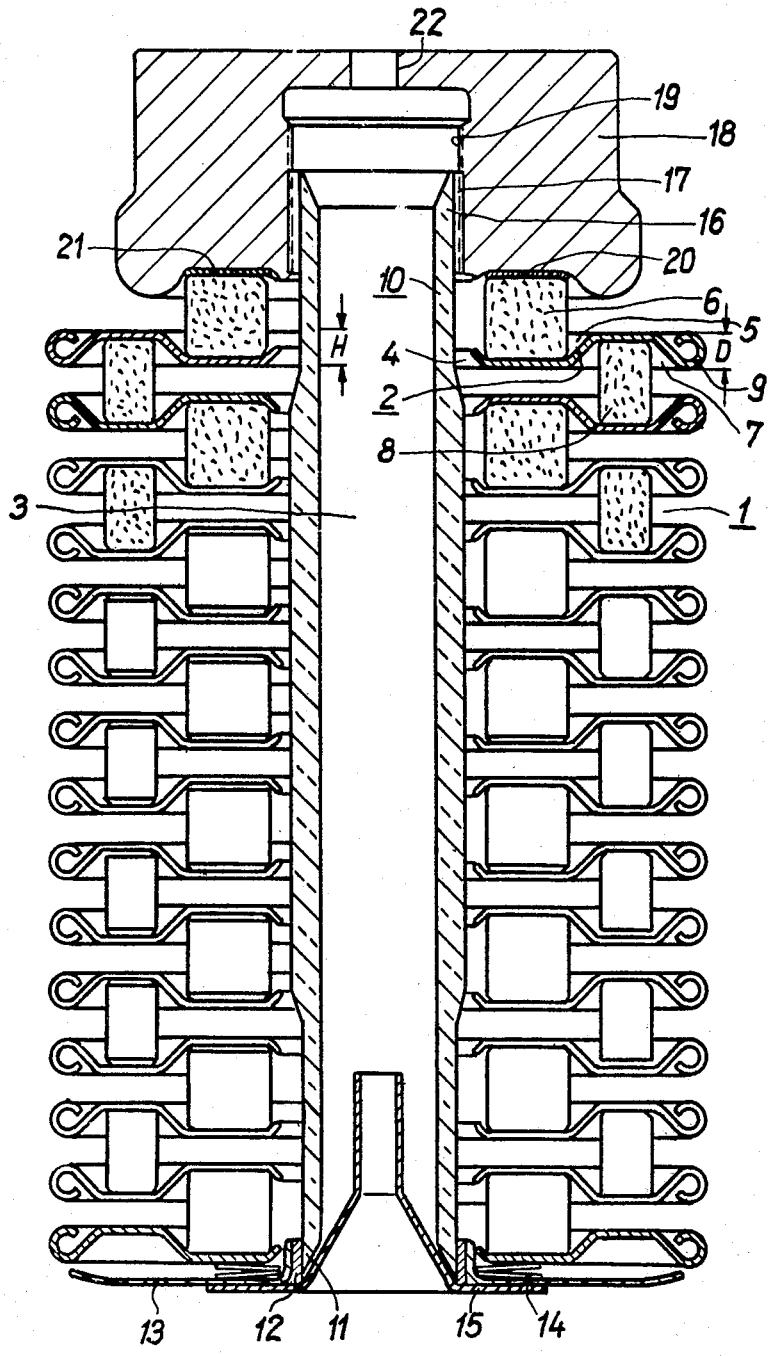
22
19
18
17
16
21
20
10
6
5
H
4
D
9
2
7
8
3
1
13
12
11
15
14

RESISTOR DEVICE PARTICULARLY FOR HIGH-VOLTAGE INSTALLATIONS

BACKGROUND OF THE INVENTION

The present invention relates to a resistor device, particularly to a stacked high voltage resistor device.

Austrian Patentschrift 163,127 discloses a resistive device for high voltage installations in which resistance elements of different diameters are placed on top of each other along a common axis to form a stack. The resistors are connected to each other by disc-shaped contact elements. An inner resistance element in the form of a solid circular cylinder is interleaved along a common axis between two annular outer resistance elements of larger diameter than that of the inner resistance element. Each disc-shaped contact element has an embossing or recess on one side exposed for receiving an inner resistance element and an embossing or recess on the other side exposed for receiving an outer resistance element. The electrical connection between resistance elements which are to be electrically series-connected is accomplished by means of the disc-shaped contact elements disposed along the common axis between adjacent resistance elements and (electrically) separated from each other by insulating discs. The stack of resistance elements and disc-shaped contact elements is held together by means disposed outside the stack.

OBJECTS AND SUMMARY OF THE INVENTION

It is an object of the present invention to provide an improved stacked resistor device, particularly for high-voltage installations.

It is also an object of the present invention to provide such a resistor device which requires relatively little space not only in the axial direction but also in the radial direction, and which possesses great mechanical strength.

According to the invention, inner resistance elements as well as outer resistance elements of a stacked resistor device are of annular shape and are stacked in a series-connected circuit to form the resistor device. Additionally, contact elements of annular shape which have a cental cut-out are provided as support members and electrically interconnect adjacent resistance elements in the series-connected circuit. An insulating clamping sleeve is inserted into the cutouts of the contact elements and means cooperating with opposite ends of the sleeve are provided for clamping the individual resistance and contact elements together to form a stack.

Each of the contact elements includes an annular embossing or recess on each side thereof for receiving an annular resistance element. An inner annular recess receives the inner resistance element and an outer annular recess of greater diameter than that of the inner recess receives the outer resistance element.

The clamping sleeve is preferably of plastic.

The clamping means of the resistor device according to the invention comprises bushings disposed at opposed ends of the clamping sleeve. The bushings can be fastened to the clamping sleeve in various ways; however, for strength and to facilitate manufacturing, it is preferred that the bushings are cemented to the clamping sleeve.

The clamping means further comprise clamping elements cooperating with the bushings. The clamping elements, according to the invention, can take different forms. However, a clamping element in the form of a clamping disc (or washer) fastened to the bushing at one end of the clamping sleeve and a clamping element which is threaded onto the bushing at the other end of the clamping sleeve and which acts as a pressure disc are preferred.

In order to obtain a resistor device with a voltage distribution in the direction of the axis as uniform as possible, the cross sectional areas of the inner and outer resistance elements in the resistor device according to the invention are selected such that each resistance element has the same electric resistance.

Preferably, the heights of the resistance elements are equal so that, for example, the contact elements may be equally spaced, and the inner and outer resistance elements are made of the same resistance material so that they have equal volumes.

According to another aspect of the invention, each disc-shaped contact element has a revolving outer ring, the diameter of which is the same as the height of the disc-shaped contact element. The disc-shaped contact elements advantageously are adjacently disposed with their outer rings equally spaced. This provides an advantageous effect with respect to the electrical properties of the resistor device according to the invention, especially when subjected to surge voltages.

An advantage of the resistor device according to the invention is the central arrangement of the sleeve and clamping means within the stack forming the resistor device, so that no additional space is needed in the radial direction for parts required to clamp the stack. A further advantage provided by the central clamping arrangement of the resistor device according to the invention is great mechanical strength of the stacked device. Strength can be increased by providing in accordance with the invention annular-shaped contact elements as bearing members which can be relatively solid.

Inductive voltage transformers for completely-insulated metal-encapsulated high-voltage switching installations are designed quite compact. A further advantage can be obtained when the resistor device according to the invention, which is also quite compact, is used in such installations.

The clamping sleeve of the resistor device according to the invention is stressed in tension. Advantageously, it therefore is made of a fiber-reinforced plastic material, e.g., a fiberglass material. However, the use of a textile fiber-reinforced casting resin is preferred because such a plastic has been found to be suitable for use in $SF_6$ insulated switching installations.

These and other objects, aspects, features and advantages of the invention will be more apparent from the following description of the preferred embodiment thereof when considered with the accompanying drawing and appended claims.

BRIEF DESCRIPTION OF THE DRAWINGS

The present invention is illustrated by way of example and not limitation in the sole FIGURE of the accompanying drawing which is a longitudinal section view of a resistor device according to the invention.

DESCRIPTION OF THE PREFERRED EMBODIMENTS

Referring more particularly to the drawing, the resistor device 1 according to the invention includes a multiplicity of annular contact elements 2 successively arranged along the direction of an axis 3 of the resistor device 1. The contact elements 2 are thereby coaxially stacked. Each annular-shaped contact element 2 has a central cutout 4 and is provided with an annular embossing or recess 5 open or exposed on one side for receiving an annular inner resistance element 6 of relatively small diameter. Each annular-shaped contact element 2 is further provided with another annular embossing or recess 7 open or exposed on the other side of the contact element 2 for receiving an outer annular resistance element 8 of comparatively larger diameter. Each annular-shaped contact element 2 also includes an outer portion turned into a ring 9 which has a diameter D corresponding to the height H of the contact element 2. The ring 9 controls the electric field strength and prevents the field strength from locally exceeding a permissible value.

Along the common axis 3, an outer resistance element 8 of larger diameter follows each inner resistance element 6 of smaller diameter. The metallic connection between successive resistance elements 6 and 8 is accomplished via the annular-shaped contact elements 9 which are identical, as the same configuration can be used for the annular-shaped contact element above the outer resistance element 8 and the annular-shaped contact element disposed below the outer resistance element 8, the positions of the two contact elements being reversed.

The inner resistance elements 6 and the outer resistance elements 8 are of the same height; however, their diameters and cross-sections are different so that each element 6, 8 can have the same resistance using the same resistance material for each element.

A clamping sleeve 10 of a high stress, preferably fiber-reinforced plastic is inserted through the annular-shaped contact elements 2 in the area of their central opening 4. The clamping sleeve 10 is provided at one end 11 with a clamping bushing 12 cemented to the end 11 of the clamping sleeve 10.

To the bushing 12 is fastened a clamping disc 13 which has a diameter almost as large as that of the annular-shaped contact elements 2. For insulating purposes, the clamping disc 13 includes a portion at its outer circumference bent in the direction of the annular-shaped contact element 2 disposed adjacent to the clamping disc. Coil springs 14 are arranged between the clamping disc 13 and said adjacent annular-shaped contact element 2. In addition, a contact piece 15 is disposed on the exterior side of the clamping disc 13 extending through the clamping disc into the interior of the clamping sleeve 11. The contact piece 15 receives a contact pin (not shown) by means of which the resistor device 1 is connected on that side.

An externally-threaded bushing 17 is cemented to the clamping sleeve 11 at the other end 16 of the sleeve. A pressure washer 18 having an internal thread 19 is screwed onto the bushing 17. The pressure washer 18 is provided with a recess 20 on its side facing the interior of the resistor device 1 for receiving the uppermost inner resistance element 6 and maintaining it in position in cooperation with an adjacent contact element. A washer 21 prevents the screwed on pressure washer 18 from damaging the uppermost inner resistance element 6. Screwing the pressure washer 18 onto the bushing 17 clamps the stack of resistance elements 6 and 8 and the annular-shaped contact elements to form a mechanically strong structure in which the annular-shaped contact elements, which can be of relatively solid construction and can thereby also serve as structural elements, contribute substantially to the mechanical strength of the device.

The resistor device 1 is electrically connected on the side thereof at the top of the figure via the pressure washer 18 which has a central bore 22 for that purpose. Another contact pin (not shown) can be inserted between the central bore 22 of the resistor device 1, and, for example, an inner conductor of a completely insulated metal-encapsulated high-voltage switching installation to make an electrical connection therebetween.

The resistor device according to the invention can advantageously be used for high voltage installations and possesses great mechanical strength.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purposes of the disclosure without departing from the spirit and scope of the invention.

What is claimed is:

1. A resistor device comprising a plurality of annular resistance elements of which an inner annular resistance element is interleaved between two outer annular resistance elements of larger diameter than that of the inner resistance element, annular-shaped contact elements having a central cutout interposed between adjacent resistance elements for electrically connecting adjacent resistance elements, each contact element having an annular recess of larger diameter on one side thereof for receiving the outer resistance element and another annular recess of smaller diameter for receiving the inner resistance element, a clamping sleeve of insulating material disposed in the central cutouts of the contact elements, and means cooperating with opposed ends of the clamping sleeve for clamping the stack together.

2. The resistor device according to claim 1, wherein the clamping sleeve is of plastic.

3. The resistor device according to claim 2, wherein the clamping sleeve is of a fiber-reinforced plastic.

4. The resistor device according to claim 1 or 3, wherein the clamping means comprises bushings disposed at opposed ends of the clamping sleeve.

5. The resistor device according to claim 4, wherein the bushings are cemented to the clamping sleeve.

6. The resistor device according to claim 4, wherein the clamping means includes a clamping disc of insulating material fastened to a bushing at one end of the clamping sleeve.

7. The resistor device according to claim 6, wherein the clamping means includes an external thread on the bushing at another end of the clamping sleeve and a clamping element having an internal thread threaded onto said external thread of the bushing.

8. The resistor device according to claim 1, wherein the inner resistance elements and the outer resistance elements have equal heights but unequal diameters such that the resistance elements have equal electric resistance.

9. The resistor device according to claim 8, wherein the inner and outer resistance elements are made of the same resistance material and have the same volume.

10. The resistor device according to claim 1, wherein each annular-shaped contact element includes an outer ring portion the diameter of which is equal to the height of the annular-shaped contact elements.

* * * * *